United States Patent [19]

Gorondy

[11] 4,427,412

[45] * Jan. 24, 1984

[54] MAGNETIC PRINTING OF DISPERSE-DYEABLE TEXTILE MATERIAL

[75] Inventor: Emery J. Gorondy, Chadds Ford, Pa.

[73] Assignee: E. I. Du Pont de Nemours and Company, Wilmington, Del.

[ * ] Notice: The portion of the term of this patent subsequent to Dec. 20, 2000 has been disclaimed.

[21] Appl. No.: 392,786

[22] Filed: Jun. 28, 1982

[51] Int. Cl.³ ..... B30B 15/34; G03G 19/20

[52] U.S. Cl. ..... 8/471; 8/922; 8/468; 156/583.1; 346/74.2

[58] Field of Search ..... 8/471

[56] References Cited

U.S. PATENT DOCUMENTS

| | | | |
|---|---|---|---|
| 3,860,388 | 1/1975 | Haigh | 8/471 |
| 3,915,628 | 10/1975 | Bossard et al. | 8/471 |
| 4,099,186 | 7/1978 | Edwards et al. | 346/74.1 |
| 4,117,498 | 9/1978 | Edwards et al. | 346/74.1 |
| 4,124,384 | 11/1978 | Centa | 96/14 |
| 4,145,300 | 3/1979 | Hendriks | 252/62.1 |
| 4,174,250 | 11/1979 | Durand | 8/471 |
| 4,246,331 | 1/1981 | Mehl et al. | 430/107 |

*Primary Examiner*—A. Lionel Clineman

[57] ABSTRACT

A process is described for printing dyes onto a textile material comprising the steps of forming a latent magnetic image in a magnetic imaging member comprising a ferromagnetic material on an electrically conductive support; developing the magnetic image by applying a ferromagnetic toner comprising a ferromagnetic component, a dye component which is substantially sublimable at from 160° C. to 215° C., transferring the developed image to a substrate comprising a continuous belt comprising a thermally stable, dielectric, non-dye-receptive material; covering the developed image with a layer of a thermally stable resin which is permeable to said dye component bringing the continuous belt into contact with a textile material to be dyed while the belt and fabric are rotated upon a heated drum, with the textile material facing the covering layer of resin of the continuous belt, to thereby transfer said dye component from the continuous belt to the textile material; washing and drying the continuous belt.

9 Claims, 2 Drawing Figures

MAGNETIC PRINTING OF DISPERSE-DYEABLE TEXTILE MATERIAL

BACKGROUND OF THE INVENTION

1. Field of the Invention

This invention relates to a process for printing dyes onto textile fabrics. More particularly, the process relates to forming a dye image of a sublimable dye on a substrate by magnetic printing, and transferring the dye image from the substrate to a film or textile fabric by sublimation thereof through a layer of resin.

2. Description of the Prior Art

In the conventional printing of textiles, normally the fabric is adhered to a printing blanket that transports it under the printing rolls or screens. After all colors have been applied, the fabric goes through oven drying, then the dyes are fixed, e.g., by hot air or high pressure—high temperature steam. The textiles are then scoured and dried. In structurally unstable fabrics, such as double knits, waste, due to inadequate registration of the different colors, in some cases, may amount to 20 to 30% of the printed textile.

Magnetic printing processes, particularly useful in overcoming the problem in electrostatic copying processes of unsatisfactory copying of large dark areas, are known in the art. Such processes are described, for instance, in U.S. Pat. Nos. 4,099,186 and 4,117,498. The particular processes described in U.S. Pat. Nos. 4,099,186 and 4,117,498 relate to processes wherein a dye and/or other chemical treating agent contained in a ferromagnetic toner is transferred directly to a substrate e.g., such as a textile material, or is transferred to a first substrate such as paper for subsequent transfer to the ultimate substrate.

U.S. Pat. No. 3,860,388 describes a method of dye absorption into the surfaces of plastics by placing a polyethylene film between a dye transfer paper and a sheet of plastic and applying pressure and heat thereto. The dyes sublime through the polyethylene film to the plastic film to be dyed.

U.S. Pat. No. 3,915,628 relates to a continuous dry transfer-printing process for textile webs wherein a continuous inert carrier, advantageously stainless steel, aluminum or paper, is applied to the surface of the web, which is then contacted with the material to which the dye is to be transferred followed by heating and sublimation of the dye.

SUMMARY OF THE INVENTION

It has now been found that a process for dyeing substrates such as textile materials using magnetic printing onto a thermally stable, dielectric, non-dye-receptive continuous belt with subsequent transfer of the dye component of the developed image to the final substrate can be used to virtually eliminate the problem of inadequate registration in multi-color printing of substrates such as films and textile materials.

More specifically, the process of the invention for dyeing a substrate comprises the steps of: forming a latent magnetic image on a magnetic imaging member comprising a ferromagnetic material imposed on an electrically conductive support; developing the magnetic image by applying thereto a ferromagnetic toner comprising a ferromagnetic component, a dye component which is substantially sublimable at from about 160° to 215° C., and a resin which substantially encapsulates the ferromagnetic component and the dye component; transferring the developed image to a substrate comprising a continuous belt comprising a thermally stable, non-dye-receptive material which in a preferred aspect of the invention is dielectric; covering the developed image with a layer of a thermally stable resin which is permeable to said dye component; bringing the continuous belt into contact with the substrate to be dyed while the belt and fabric are rotated upon a heated drum, with the textile material facing the covering layer of resin of the continuous belt, to thereby transfer said dye component from the continuous belt through the covering layer to the textile material; washing and drying the continuous belt.

DETAILED DESCRIPTION OF THE DRAWINGS

Figure 1:
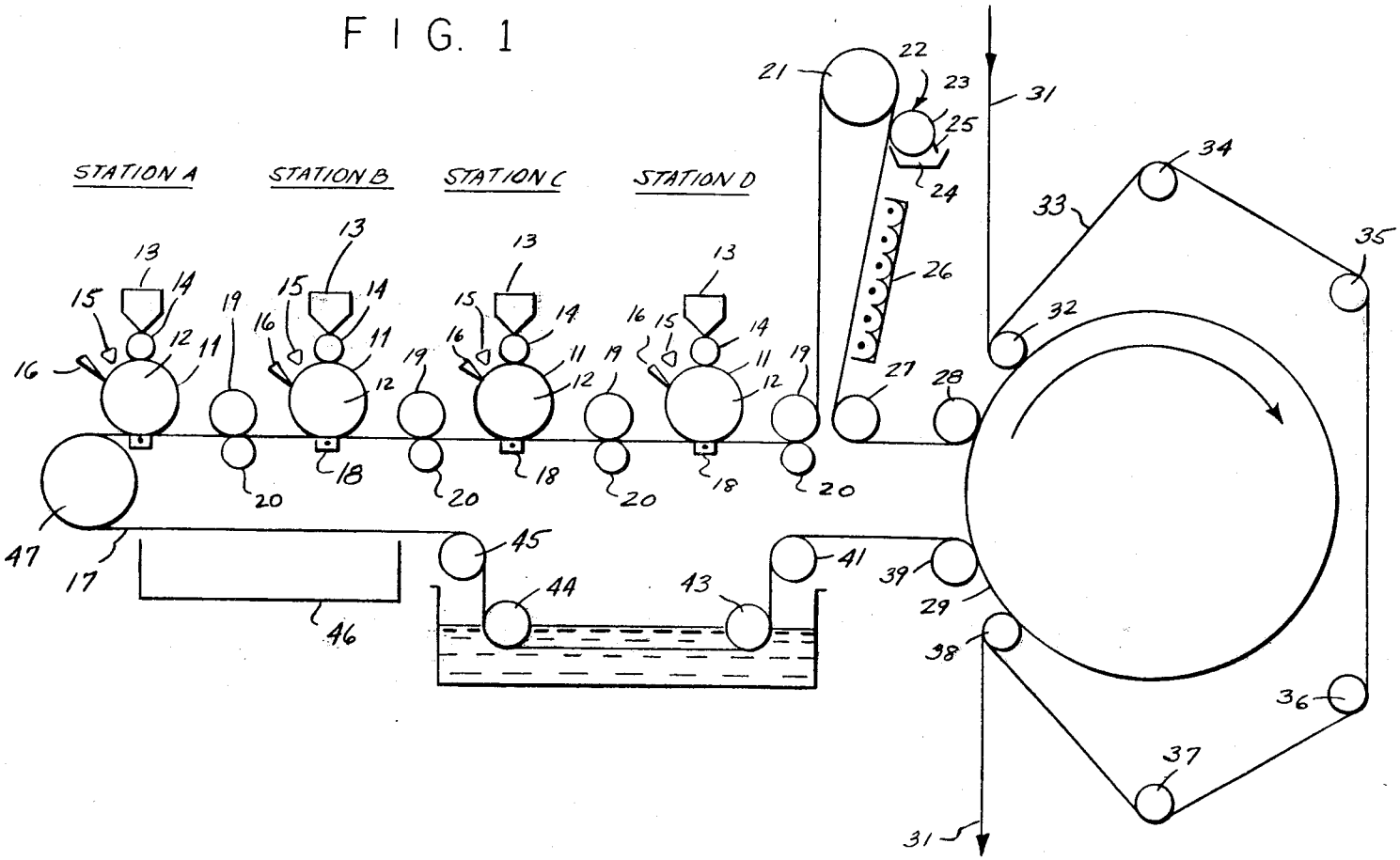
FIG. 1 a schematic diagram of an apparatus for practicing the process of the invention.

Referring now to FIG. 1, a latent magnetic image of one of the colors (yellow, magenta cyan or black in each of stations A, B, C and D) making up the design to be printed is formed on the surface of each of magnetic imaging members 11 mounted on drums 12. The latent magnetic image is decorated with ferromagnetic toner particles contained in hoppers 13 using suitable decorating means. In the particular embodiment illustrated, the decorating means consists of hoppers 13 having a narrow orifice from which the toner particles are smoothly and uniformly dispensed onto the surface of magnetized rolls 14. The toner particles adhering to magnetic rolls 14 are subsequently driven by magnetic attraction from the roll to the latent magnetic image on magnetic imaging members 11. The surface of toner decorated imaging members 11 is neutralized with AC coronas 15 and vacuum cleaned with vacuum knives 16 to remove toner particles which have adventitiously become attracted to the demagnetized background areas of imaging members 11. The toner is transferred to endless belt 17 by the action of DC corona or DC voltage biasing roll 18. After transfer of the toner to endless belt 17 the toner is fused by being passed between heated pressure roll 19 and backing roll 20 before being passed to the next station. Alternatively endless belt 17 can go directly to the next printing station, and the toner fused after leaving the last printing station. After passing each of stations A, B, C and D endless belt 17 is fed around roller 21 to coating station 22. Coating station 22 comprises a roller immersed in a bath 24 of a coating composition. Doctor knife 25 is used to control the amount of the coating composition which is applied to endless belt 17. After leaving coating station 22, the coating on endless belt 17 is dried with heater 26 which contains a battery of infrared lamps. After leaving heater 26, endless belt 17 is passed around rollers 27 and 28 and onto the surface of heated drum 29. Textile 31 is fed around roller 32 and under endless belt 33. Rollers 32, 34, 35, 36, 37 and 38 serve to urge endless belt against heated drum 29 and thus urge textile 31 against heated drum 29. Heated drum 29 is heated to a temperature which is sufficient to cause the dye which was in the toner which was applied to endless belt 17 at stations A, B, C and D to sublime and diffuse through the coating which was applied at coating station 22 and dye the surface of textile 31. After textile 31 is dyed it is fed around roller 38 and removed as finished product. Endless belt 17 is fed around rollers 39 and 41, and into wash box 42, around roller 45 past dryer 46 and around roller 47 to station A where the process begins again.

Figure 2:
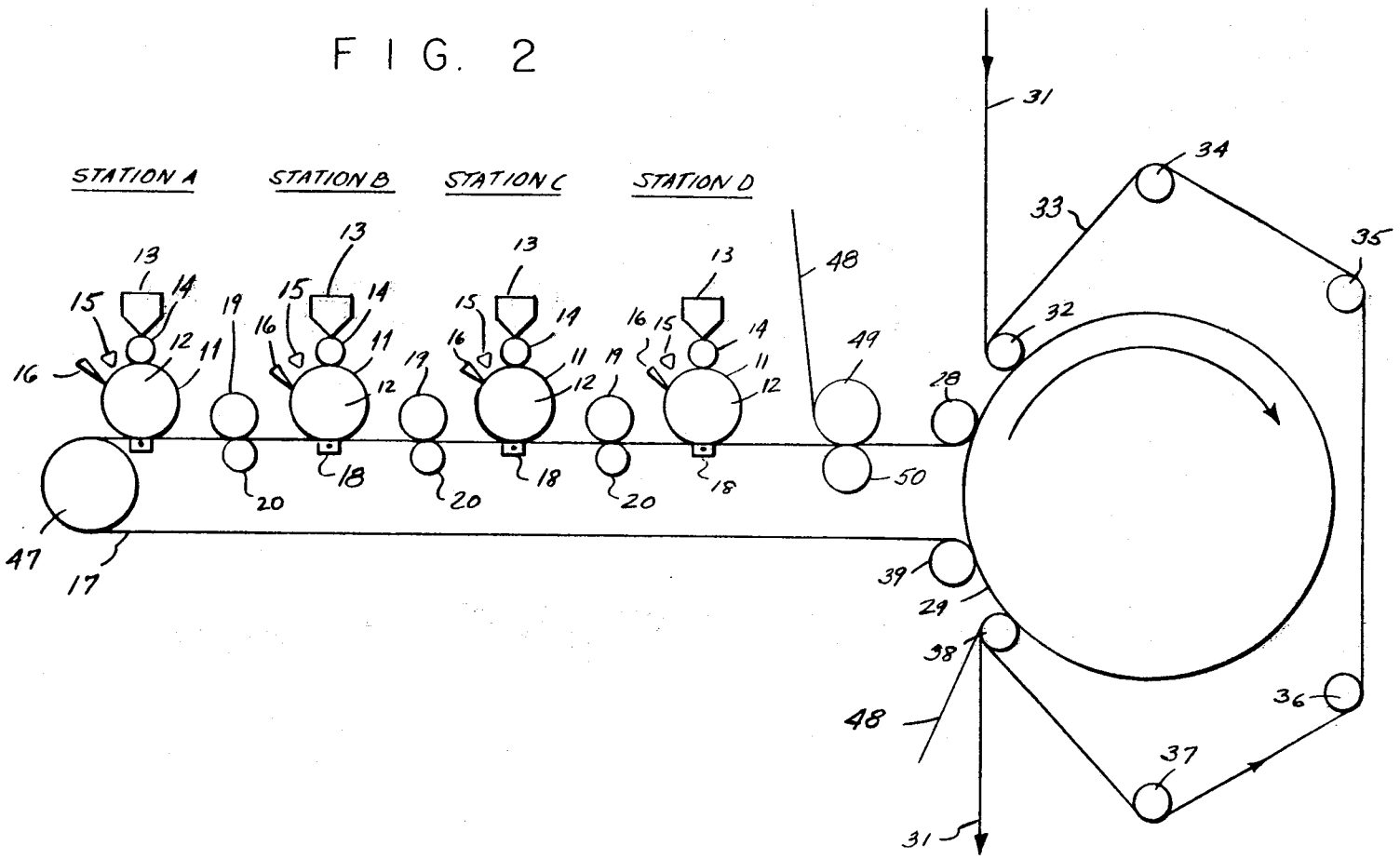
FIG. 2 is a schematic diagram of an alternative apparatus for practicing the process of the invention.

Referring now to FIG. 2, endless belt 17 is past stations A, B, C and D as described above for FIG. 1. On leaving station D a dye permeable polymeric film 48 is fed along with endless belt 17 between heated laminating rolls 49 and 50. The film 48 is removed after it passed roller 38.

DETAILED DESCRIPTION OF THE INVENTION

The formation of a latent magnetic image in a ferromagnetic material imposed on an electrically conductive support can be accomplished by techniques known in the art of magnetic recording. Examples of such techniques are described in U.S. Pat. Nos. 4,009,186 and 4,117,498, the disclosures of which are incorporated herein by reference.

In the invention the magnetic image is developed by applying a ferromagnetic toner comprising a ferromagnetic component, a dye component, and a resin, which preferably is water soluble or solubilizable, and which substantially encapsulates the ferromagnetic component and the dye component.

The ferromagnetic component of the ferromagnetic toner can consist of hard magnetic particles, soft magnetic particles, or a binary mixture of hard and soft magnetic particles. Such particles are described in U.S. Pat. Nos. 4,099,186 and 4,117,498.

The dye component used in the ferromagnetic toner must be sublimable at a temperature of less than 215° C. Dyes falling into this category include low-energy and medium-energy dyes, with medium-energy dyes being preferred. Examples of such dyes include

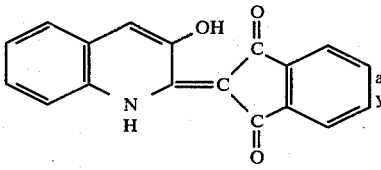

a medium energy yellow disperse dye,

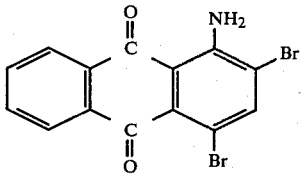

a low to medium energy red disperse dye,

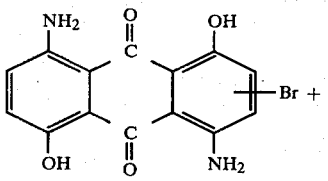

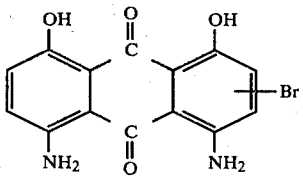

a medium energy blue disperse dye, and

-continued

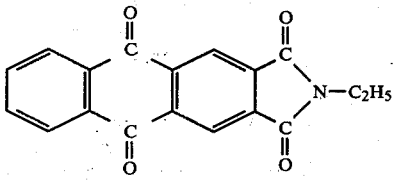

a greenish blue disperse dye.

The concentration of the dye component in the ferromagnetic toner can vary over a range of from about 0.5% to about 10.0% by weight, based on the total weight of the toner. In a preferred embodiment, the concentration of dye component is between 1.0% and 3.0% by weight.

When using the process as depicted in FIG. 1 the resin which encapsulates the ferromagnetic component preferably is water soluble or water-solubilizable. The suitable water soluble or water-solubilizable resins which for encapsulating the ferromagnetic component and the dye component of the ferromagnetic toner may be any known, readily fusable, natural, modified natural, or synthetic resin or polymer which are soluble or solubilizable in water. Examples of such resins are described in U.S. Pat. Nos. 4,099,186 and 4,117,498, as well as the specific encapsulation technique therefore.

The relative amounts of resinous material and ferromagnetic component in the toner are determined by the desired adhesive and magnetic properties of the toner particle. Generally, a ratio of resinous material to ferromagnetic material of 0.11:1 to 3.3:1 is useful, with the range of 0.40:1 to 1.0:1 being preferred.

Other components may optionally be added to the ferromagnetic toner, such as those described in U.S. Pat. Nos. 4,099,186 and 4,117,498.

In the invention the developed image is formed on a continuous belt comprising a thermally stable, dielectric, non-dye-receptive material. Examples of such materials include a sodium-etched layer of poly (tetrafluoroethylene) on a fiberglass belt material or on a belt of aramide fibers.

In the process of the invention the developed image on the continuous belt is covered with a layer of a thermally stable resin which is permeable to the dye component of the ferromagnetic toner. The covering layer may be formed directly on the developed image on the carrier belt (FIG. 1), or, the covering layer may be a previously formed layer, such as a polymeric film, which is brought into contact with the developed image on the continuous belt (FIG. 2). The layer must be thermally stable and must be permeable to the sublimed dye component. Examples of resin which can be used to form the covering layer according to the invention include polyester film, e.g., Mylar®.

Textile materials that may be dyed according to the process of the invention include any polymers that are "disperse-dyeable", that is, material capable of forming a solid solution of the dye in the textile material. Such textile materials include polyesters and nylon, with polyesters being particularly preferred.

The following examples are intended to illustrate, but not limit the process of the invention.

EXAMPLE 1

A yellow toner mix is prepared by mixing 5.0 wt % of

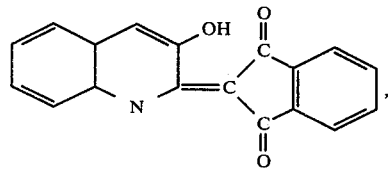

40.0 wt % Carboset XL 11, a terpolymer of methyl methacrylate, ethyl acrylate and acrylic acid having a glass transition of 55° C. and an acid No. of 74 mg KOH/g, 1.5 wt % Reax 85 A lignosulfonate dispersing agent and 53.5 wt % of Magnetic Oxide No. 7029, $Fe_3O_4$ type ferroferric oxide are mixed together.

A red toner mix is prepared by mixing 7.0 wt % of

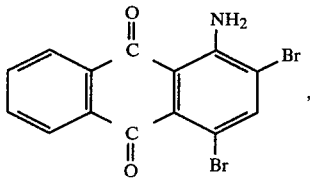

37.61 wt % carboset XL 11, 1.89 wt % Reax 85 A, and 53.50 wt. % Magnetic Oxide No. 7029.

A blue toner mix is prepared by mixing 7.0 wt %

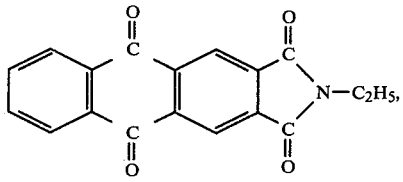

38.1 wt % Carboset, XL 11, 1.4 wt % Reax 85 A and 53.5 wt % Magnetic Oxide No. 7029.

A black toner mix is prepared by mixing 3.00 wt % of the above yellow dye, 4.50 wt % of the above red dye, 4.00 wt % of the above blue dye, 36.95 wt % of Carboset XL 11, 1.55 wt % Reax 85 A, and 50.00 wt % Magnetic Oxide No. 7029.

The toner mixes are converted into toner by spray drying an aqueous dispersion of the components set forth above.

Each of the magnetic imaging members are formed of a 350μ inches (8.9μ meters) thick layer of acicular chromium dioxide in a binder on an electrically grounded silver-coated rubber roll which is 12 inches (0.3 meter) wide. The magnetic imaging member is magnetically structured to 460 pole reversals/inch (18 pole reversals/mm) or 230 cycles 1 inch (9 cycles/mm) or 55 microns/pole reversal by recording a square wave with a magnetic write head at 35 m Amps and 6 to 8 Volts. A film positive of the individual colors to be printed is placed in contact with the magnetically structured roll and stepwise uniformly illuminated by a Xenon flash at 3.3 KV with a 15° turn per flash, passing through the film positive. The dark areas of the film positive, corresponding to the areas to be printed, absorb the energy of the Xenon flash; whereas the clear areas transmit the light and heat the acicular chromium dioxide beyond is Curie point of about 116° C. thereby demagnetizing the exposed magnetized lines of acicular chromium dioxide.

The thusly magnetized rolls are then registered with each other in the apparatus depicted in FIG. 1.

The four toners are individually fed from a slot in the hoppers to decorate the latent magnetic images in each of the magnetic imaging members by a decorator. The decorator comprises a rotating magnetic cylinder inside a non-magnetic sleeve. As the magnetic imaging member rotates after being decorated with toner it first passes an AC corona which serves to neutralize any electrostatic charges which may be adhering toner to the magnetic imaging member. Then, a vacuum knife removes stray toner from the non-image areas. The toner is then negatively charged with a DC corona. The toner is then transferred to an endless polytetrafluoroethylene coated woven aramide fiber belt. A negatively charged voltage biasing roll on the backside of the belt is used to effect transfer of the toner from the magnetic imaging member to the belt. After toner transfer the imaging member passes in this order, an AC corona, a brush and a vacuum knife to remove any remaining toner, prior to returning to the decorator. This is repeated at each of the remaining printing stations. Between transfer stations the toner particles are coalesced together by passing them between a heated pressure roll and a backing roll which heat the toner to about 90° C. The belt with the toner image is then fed, along with a 0.5 mil (0.013 mm) thick poly(ethylene terephthalate) film, between a heated roll maintained at 110° C. and an unheated nip roll to form a laminate.

The laminate is fed, together with a textile fabric around a heated drum and an endless pressure belt of Teflon ®. The surface of the drum is maintained at 210° C. The pass around the drum utilizes a residence time of 30 seconds. After passing around the drum the textile fabric and the Mylar ® film are separately taken up on rolls. The fabric used is a woven 24 gauge 100% poly(ethylene terephthalate) weighing 5.7 oz/Yd$^2$ (0.19 Kg/m$^2$).

EXAMPLE 2

Example 1 is repeated except instead of laminating a Mylar ® film over the image on the endless belt an aqueous solution of hydroxyethylcellulose is coated on the belt by means of an application roll in a reservoir and dried with a battery of infrared lamps to provide a 0.5 mil (0.013 mm) thick coating. The dye is sublimed through the coating to dye the fabric as in Example 1. The resulting fabric is taken up on a roll and the coating is washed from the belt with an aqueous bath.

I claim:

1. A process for printing a sublimable dye onto a textile material comprising the steps of:

forming a magnetic image in a magnetic imaging member comprising a ferromagnetic material on an electrically conductive support;

developing the magnetic image by applying a ferromagnetic toner comprising a ferromagnetic component, a dye component which is substantially sublimable at from about 160° to 215° C., and a resin which substantially encapsulates the ferromagnetic component and the dye component;

transferring the developed image to a substrate comprising a continuous belt formed of thermally stable, dielectric, non-dye-receptive material;

covering the developed image with a layer of a thermally stable resin which is permeable to said dye component;

then bringing the continuous belt into contact with a textile material to be printed while the belt and fabric are rotated upon a heated drum, with the textile material facing the covering layer of resin of the continuous belt, to thereby transfer said dye component from the continuous belt through the covering layer to the textile material; separating the textile material from the continuous belt; and removing the resin from the continuous belt.

2. The process of claim 1 wherein the ferromagnetic material is subjected to the action of a charge dissipating means prior to developing the magnetic image.

3. The process of claim 1 wherein the continuous belt is a fiberglass belt material coated with a layer of poly(-tetrafluoroethylene).

4. The process of claim 1 wherein the continuous belt comprises an aramide fabric coated with a layer of ploy(tetrafluoroethylene).

5. The process of claim 1 wherein the textile fabric is a polyester.

6. The process of claim 5 wherein the covering layer is polyvinyl alcohol which is washed off after the textile is dyed.

7. The process of claim 5 wherein the covering layer of thermally stable resin is hydroxyethylcellulose which is washed off after the textile is dyed.

8. The process of claim 5 wherein the covering layer of thermally stable resin is a polyester film.

9. A process as in claim 8 wherein the polyester film is between about 0.0064 mm (0.25 mil) and 0.0254 mm (1.0 mil) thick.

* * * * *